US008308171B2

(12) United States Patent
Farrelly

(10) Patent No.: US 8,308,171 B2
(45) Date of Patent: Nov. 13, 2012

(54) PERSONAL TRANSPORTATION DEVICE FOR SUPPORTING A USER'S FOOT HAVING MULTIPLE TRANSPORTATION ATTACHMENTS

(76) Inventor: Ryan Farrelly, San Diego, CA (US)

( * ) Notice: Subject to any disclaimer, the term of this patent is extended or adjusted under 35 U.S.C. 154(b) by 0 days.

(21) Appl. No.: 12/536,437

(22) Filed: Aug. 5, 2009

(65) Prior Publication Data

US 2010/0176565 A1 Jul. 15, 2010

Related U.S. Application Data

(63) Continuation of application No. 11/386,822, filed on Mar. 23, 2006, now abandoned, which is a continuation-in-part of application No. 10/616,969, filed on Jul. 11, 2003, now Pat. No. 7,059,613.

(51) Int. Cl.
*A63C 1/40* (2006.01)

(52) U.S. Cl. ..... 280/11.27; 280/11.233

(58) Field of Classification Search ..... 280/11.19, 280/11.27, 11.24, 11.221, 87.041
See application file for complete search history.

(56) References Cited

U.S. PATENT DOCUMENTS

| | | | | | |
|---|---|---|---|---|---|
| 1,600,075 | A | * | 9/1926 | Stoops | 280/11.24 |
| 1,801,230 | A | | 4/1931 | Fehre | |
| D143,983 | S | | 2/1946 | Miller | |
| 2,545,543 | A | | 3/1951 | Bottrill | |
| 2,679,401 | A | | 5/1954 | Williams | |
| 2,805,078 | A | | 9/1957 | Robinson | |
| 3,021,984 | A | | 2/1962 | Engi | |
| 3,282,598 | A | | 11/1966 | Goodwin | |
| 3,374,002 | A | | 3/1968 | Lewis | |
| 3,389,922 | A | | 6/1968 | Eastin | |
| 3,476,399 | A | | 11/1969 | Finn | |
| 3,622,172 | A | | 11/1971 | Goodwin | |
| 3,722,900 | A | | 3/1973 | Dickert | |
| D231,999 | S | | 7/1974 | Engman | |
| D233,619 | S | * | 11/1974 | Kelling | D21/763 |
| 4,218,062 | A | * | 8/1980 | Brooks, Jr. | 273/108 |
| 4,460,187 | A | * | 7/1984 | Shimizu | 280/842 |
| 4,709,937 | A | | 12/1987 | Lin et al. | |
| 4,768,793 | A | | 9/1988 | Spencer | |
| 4,955,626 | A | | 9/1990 | Smith et al. | |
| 5,048,851 | A | | 9/1991 | Alarcon | |
| 5,184,446 | A | | 2/1993 | Gustavsen | |
| 5,249,376 | A | | 10/1993 | Capria | |
| 5,388,846 | A | | 2/1995 | Gierveld | |
| 5,398,950 | A | | 3/1995 | Tkaczyk | |
| 5,419,570 | A | | 5/1995 | Bollotte | |

(Continued)

FOREIGN PATENT DOCUMENTS

CN 2301232 12/1998

(Continued)

OTHER PUBLICATIONS

International Search Report for International Application No. PCT/US04/22386, dated May 16, 2005, in two pages.

(Continued)

*Primary Examiner* — Jeffrey J Restifo

(57) ABSTRACT

A personal transport device including a transportation attachment, a foot platform situated above the transportation attachment and at least one fastener connecting the foot platform to the transportation attachment. The foot platform has two parallel extending surfaces supporting a user's foot so that the longitudinal axis of the user's foot can be positioned roughly perpendicular to the direction of travel of the transportation attachment The transportation attachment can be wheels, skates or even skis.

8 Claims, 7 Drawing Sheets

U.S. PATENT DOCUMENTS

| | | | | |
|---|---|---|---|---|
| 5,421,596 | A | 6/1995 | Lee | |
| 5,458,351 | A | 10/1995 | Yu | |
| 5,566,956 | A | 10/1996 | Wang | |
| 5,601,299 | A | 2/1997 | Yun et al. | |
| 5,660,401 | A | 8/1997 | Yi | |
| 6,070,885 | A * | 6/2000 | Ferone | 280/11.19 |
| 6,241,264 | B1 * | 6/2001 | Page | 280/11.19 |
| 6,267,394 | B1 * | 7/2001 | Bouden | 280/87.042 |
| 6,301,771 | B1 | 10/2001 | Benoit | |
| 6,561,530 | B2 * | 5/2003 | Carbonero | 280/87.041 |
| 6,764,082 | B2 * | 7/2004 | Roderick | 280/11.223 |
| 6,832,765 | B1 * | 12/2004 | Walton | 280/11.221 |
| D505,469 | S | 5/2005 | Joung et al. | |
| 6,981,711 | B2 * | 1/2006 | Seta | 280/87.05 |
| 7,059,613 | B2 * | 6/2006 | Farrelly et al. | 280/11.27 |
| D535,714 | S | 1/2007 | Cheng et al. | |
| 7,341,261 | B2 * | 3/2008 | Shing | 280/11.27 |
| D567,318 | S | 4/2008 | Farrelly et al. | |
| 7,467,681 | B2 * | 12/2008 | Hiramatsu | 180/188 |
| 7,484,742 | B2 * | 2/2009 | Choi | 280/87.042 |
| D610,643 | S * | 2/2010 | Chen | D21/764 |
| 7,712,749 | B2 * | 5/2010 | Moon et al. | 280/11.19 |
| 7,980,567 | B2 * | 7/2011 | Yu et al. | 280/11.221 |
| 2002/0149166 | A1 | 10/2002 | Potter | |
| 2003/0137116 | A1 | 7/2003 | Shih | |
| 2003/0155725 | A1 * | 8/2003 | Roderick | 280/11.223 |
| 2004/0041359 | A1 | 3/2004 | Im | |
| 2004/0212160 | A1 * | 10/2004 | Roderick | 280/11.24 |
| 2005/0006859 | A1 | 1/2005 | Farrelly | |
| 2006/0022417 | A1 * | 2/2006 | Roderick | 280/11.19 |
| 2006/0186617 | A1 | 8/2006 | Farrelly et al. | |
| 2007/0200305 | A1 | 8/2007 | Hanson | |
| 2008/0164666 | A1 | 7/2008 | Lioce | |
| 2009/0174163 | A1 | 7/2009 | Farrelly | |
| 2010/0090423 | A1 | 4/2010 | Farrelly | |

FOREIGN PATENT DOCUMENTS

| | | |
|---|---|---|
| CN | 2508813 | 9/2002 |
| DE | 19628248 | 1/1998 |
| FR | 2883485 | 9/2006 |
| JP | U7527 | 4/1923 |
| JP | S24-9462 | 10/1923 |
| JP | S44-10812 | 5/1969 |
| JP | 3021984 | 12/1995 |
| JP | 2001-522671 | 11/2001 |
| JP | 2005-517513 | 6/2005 |
| WO | WO 98/02217 | 1/1998 |
| WO | WO 2006/059883 | 6/2006 |
| WO | WO 2007/112291 | 10/2007 |

OTHER PUBLICATIONS

International Search Report for International Application No. PCT/US2009/030474, dated Mar. 10, 2009 in 2 pages.

International Search Report for International Application No. PCT/US2009/043844, dated Aug. 7, 2009, in 5 pages.

Japanese Office Action for Japanese Application No. P2006-520263, dated Mar. 4, 2010, in 6 pages.

Written Opinion for International Application No. PCT/US2009/030474, dated Mar. 10, 2009, in 8 pages.

Written Opinion of the International Searching Authority for International Application No. PCT/US04/22386, dated May 16, 2005, in 5 pages.

Written Opinion of the ISR for International Application No. PCT/US2009/043844, dated Aug. 7, 2009, in 7 pages.

Japanese Office Action [First] for Japanese Application No. 2010-200071, dated Oct. 27, 2010, in 4 pages.

Japanese Office Action [Second] for Japanese Application No. 2006-520263, dated Oct. 27, 2010, in 4 pages.

Search Report for Chinese Application No. 200980103589.5, dated Jul. 30, 2010, in 13 pages.

* cited by examiner

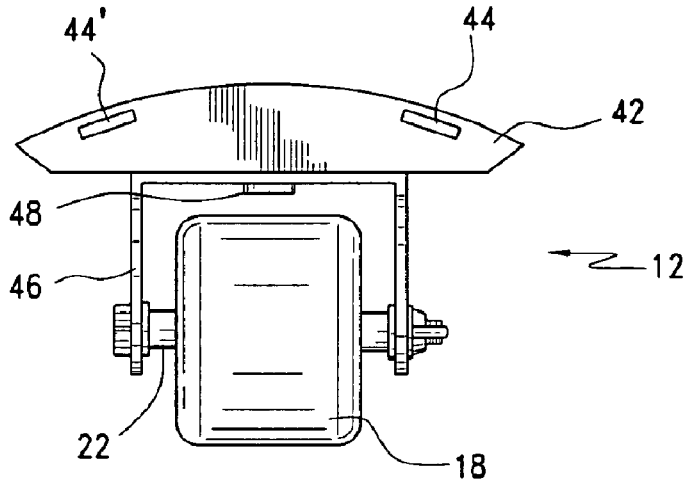
FIG. 8
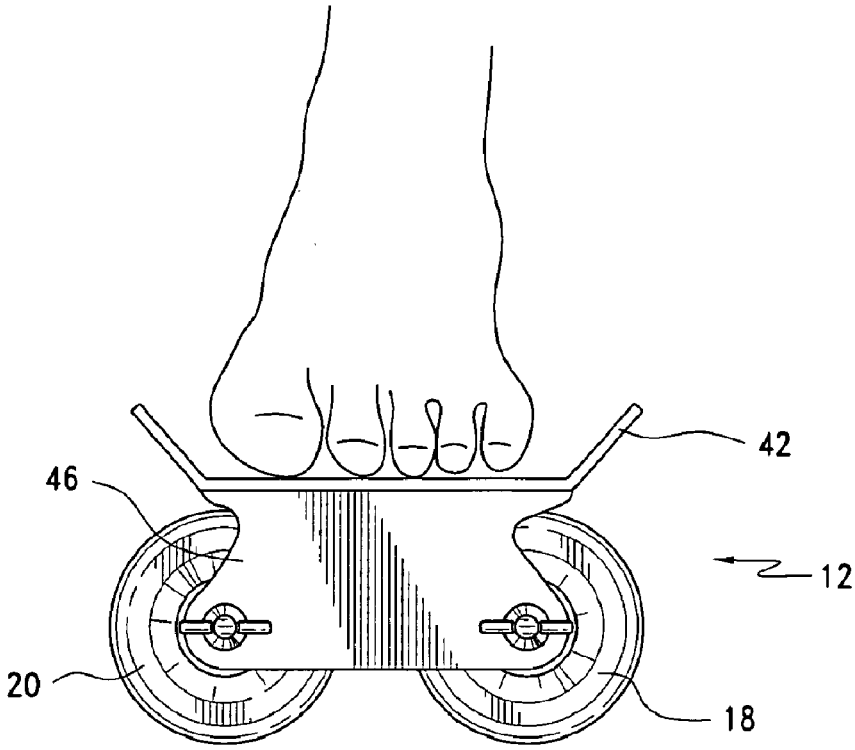

PERSONAL TRANSPORTATION DEVICE FOR SUPPORTING A USER'S FOOT HAVING MULTIPLE TRANSPORTATION ATTACHMENTS

CROSS REFERENCE TO RELATED APPLICATIONS

This application is a continuation of U.S. patent application Ser. No. 11/386,822, filed Mar. 23, 2006, which is a continuation-in-part of U.S. patent application Ser. No. 10/616,969, filed Jul. 11, 2003, now issued as U.S. Pat. No. 7,059,613, all of which are incorporated by reference herein in their entireties.

FIELD OF THE INVENTION

The present invention relates to a personal transportation device. More particularly, the present invention is directed to a personal transportation device that supports a single foot of a user and has fastened to it an easily interchanged transportation attachment. The foot support and various transportation attachments provide an innovative device that finds use for transporting a user over a wide-range of surfaces.

BACKGROUND OF THE INVENTION

By personal transportation device is meant generally those devices used in a sporting or exercise activity, such as skates, skateboards, and the like.

So-called "extreme sports" are rapidly gaining popularity as entertaining, exciting, and healthy alternatives to traditional modes of exercise and entertainment. For example, skateboarding contests are routinely held nationwide, and the sport's popularity has carried over into such popular media as video games and movies. Pro-skateboarders now have enough name recognition to warrant marketing and promotion contracts for various products. Similarly, in-line skating, street luge, and trick bike riding have all seen large increases in participation.

In order to continue the growth present in this segment of sports and entertainment, new extreme sports must be developed or existing sports improved upon. Extreme sport participants are already seeking new methods and devices to challenge their skills and provide greater excitement. For instance, skateboarding has evolved from maneuvering on flat surfaces, to down hill racing, to half-pipes and ramps, to purpose-built skate parks that simulate a variety of challenges within a small space. As the challenges have evolved, so has the technology of the skateboards. Simple two axle, wheeled wooden planks have been replaced by computer designed composite boards rolling on high-tech plastic wheels. Newer skateboards even include suspensions to aid the rider.

Skateboarders, in-line skaters, and the like are still limited by the fact that their equipment cannot be used on multiple surfaces. Once they have developed their skills, they are effectively limited to paved surfaces. For recreational users, this can be extremely limiting as local zoning laws, often prohibit skateboarding, roller skating or other recreational activities on public property.

In any event, currently available extreme sport and personal transportation devices limit acrobatic moves, hamper maneuverability and generally do not fully satisfy specific needs in personal transportation. For instance, the personal transportation market needs a device with diverse, easily interchanged attachments that can traverse a number of surfaces. In addition, there exists a need for a device that can be used in tandem to transport a user. The device, individually or in tandem, should present a challenge to recreational users and provide a unique experience for personal transportation. Therefore, the present invention satisfies the need for a customizable personal transportation device that can traverse a number of surfaces.

SUMMARY OF THE INVENTION

In accordance with the present invention, a personal transportation device is provided than can be used individually or in tandem to allow users to propel themselves. The personal transportation device of the present invention preferably includes a foot platform that can take a variety of shapes and configurations. The platform supports a user's foot and it is fastened to a transportation attachment such as a set of in-line wheels, an ice skating blade, a ski, or the like. The transportation attachment provides the capability to traverse a support surface, and the various types of transportation attachments can be quickly interchanged. The foot platform is located above the transportation attachment in relation to the support surface, and the platform supports a user's foot so that the longitudinal axis of the user's foot is positioned transverse to the intended motive direction supplied by the transportation attachment. For the purposes of the present invention, "transverse" means crossing but not necessarily perpendicular. One or more straps may also be included to hold a user's foot to the platform.

Preferably, the user will ride the distinct, unattached transportation devices in tandem. In use, the user's feet are each supported by a platform so that the length of the foot is roughly perpendicular to the motive direction supplied by the transportation device. Momentum is provided either by gravity in the form of a downhill slope or a user's oscillating leg motion. The novel construction and unique nature of using an independent device for each foot will also allow a user to perform innovative stunts and tricks. The ability to exchange the transportation attachment between wheels, skis, etc. will also allow a user to apply their skills with the device(s) on a variety of terrains.

In one embodiment, the foot platform includes two footboards with one footboard located to each side of the transportation attachment. However, the foot platform could also consist of a single unitary board that supports a single foot of a user. In addition, the foot platform can be fastened to the transportation attachment in a number of configurations.

According to another embodiment, the foot platform comprises a structure which includes a footboard and an undercarriage formed as an integral unit.

The foregoing and other embodiments will appear from the following description.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 8 is a perspective view of the personal transportation device of the present invention in accordance with a fourth embodiment of the present invention; and FIG. 9 is a side view of personal transportation device of the present invention in accordance with the embodiment of FIG. 8.

DETAILED DESCRIPTION

While the invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

Figure 1:
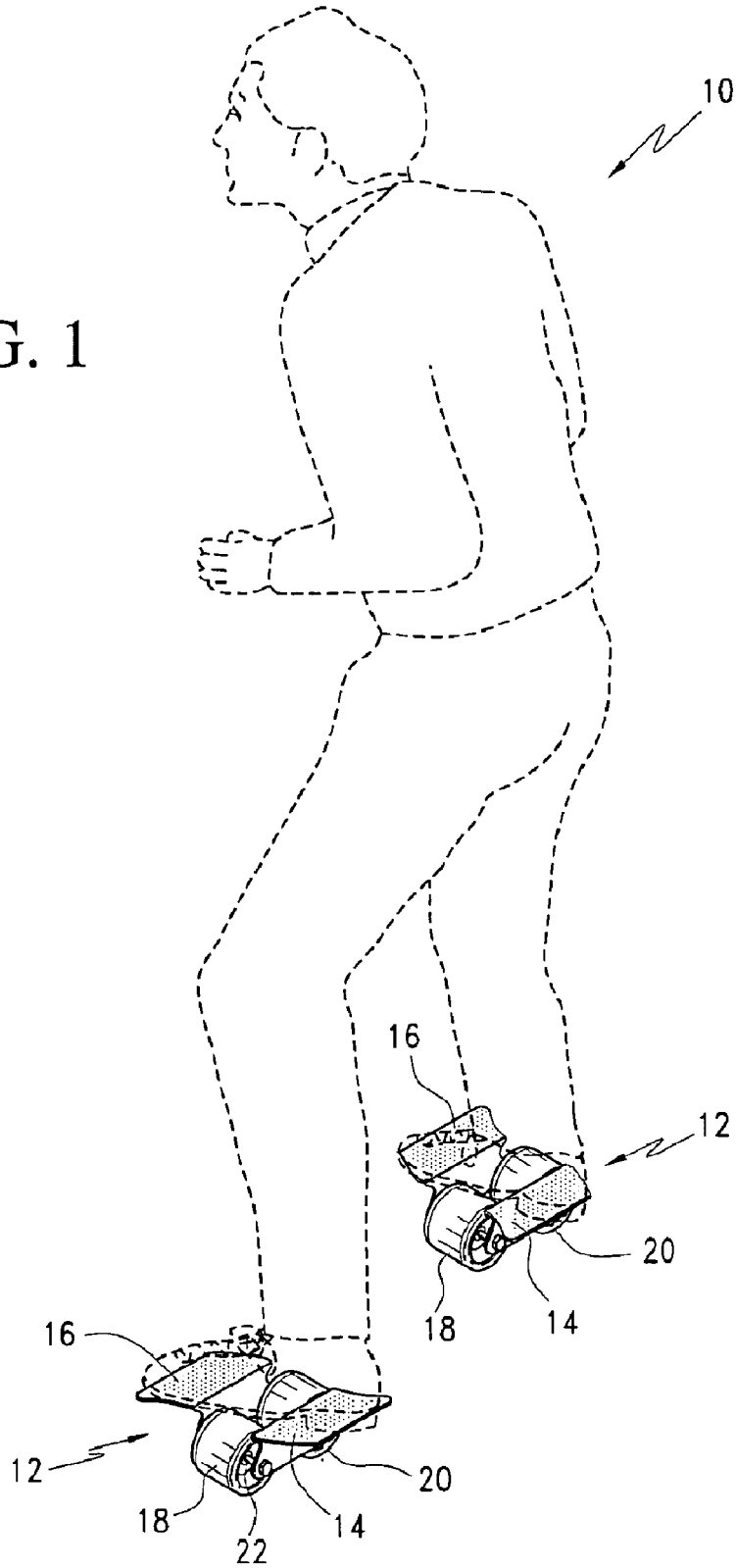
FIG. 1 is a perspective view of user employing a pair of personal transportation devices in accordance with the present invention.

A preferred embodiment of the present invention is illustrated in FIG. 1 with a user 10 standing atop a pair of personal transportation devices 12, 12'. The devices include a foot platform that can take a variety of shapes and configurations. The platform supports a user's foot, and it is fastened to a transportation attachment such as a set of in-line wheels, an ice skating blade, a ski, or the like. The transportation attachment provides the capability to traverse a support surface and is exchangeable for various types of transportation attachments. The foot platform is located above the transportation attachment in relation to the support surface, and it supports a user's foot so that the longitudinal axis of the user's foot can be positioned transverse to the intended motive direction supplied by the transportation attachment.

In the illustrated embodiment, a first footboard 14 and a second footboard 16 act as the foot platform for supporting the user's foot. Two in-line ground-engaging wheels 18, 20 serve as the transportation attachment. The wheels rotate about axles 22, 22' (see FIG. 3) allowing user 10 to move in the direction of the wheels' rotation As the foot platform supports a user's foot so that the longitudinal axis of the user's foot is positioned transverse to the direction of the wheels' rotation, user 10 assumes a stance that is roughly perpendicular, or sideways, in relation to their direction of travel. The sideways stance allows a user to place one foot further in front of the other while riding the devices. The ability to have this offset stance increases the user's balance, particularly when the terrain or support surface is off camber.

When using the device in tandem, the user can propel themselves by employing a "scissoring" or oscillating action with their legs, and the necessity of using a one legged "kick-push", which is obligatory for a traditional skateboard, is eliminated. User 10 merely oscillates their legs forward and backward, in a slightly circular manner with each leg roughly moving in the opposite direction of the other in order to create momentum. The higher a user's skill level, the quicker they will be able to oscillate their legs during use and the faster they will be able to move. Overall, the technique for riding devices 12, 12' over a flat surface is unique due to the user's sideways stance and the fact that the devices are not connected to each other in any way. Of course, user 10 could also use a single device 12 in which case the free, or unused, foot could be used for propulsion.

Figure 2:
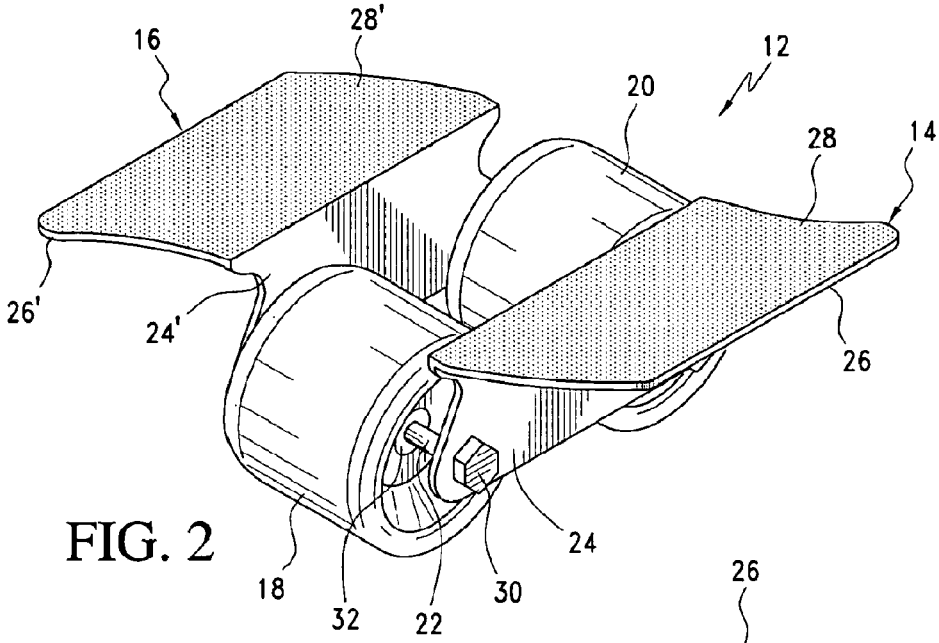
FIG. 2 is a perspective view of the personal transportation device of the present invention in accordance with the embodiment of FIG. 1.

A more detailed illustration of the present invention is presented in FIG. 2. Three main components of transportation device 12 include a foot platform, a transportation attachment, and a connection between the transportation attachment and the foot platform. As illustrated, the foot platform may include first footboard 14 and second footboard 16 while the transportation attachment may consist of two in-line wheels 18, 20. However, as will be discussed below, the transportation attachment can be an ice skate blade, a ski, or the like. Further, in place of two in-line wheels, a wheeled transportation attachment could include in-line wheels sets having two or more wheels adjacent to each other. With this arrangement, a set of wheels sharing the same radial centerline could be placed in-line with one or more sets of similarly positioned wheels with each set being fastened to the foot platform in some manner.

The footboards 14, 16 form 'L'-shaped platforms that can be constructed from a variety of materials including, but not limited to, metal, fiberglass, or plastic. An approximately ninety degree angle separates the footboards into two sections. A first section 24, 24' of each footboard is aligned vertically in relation to a support surface while a second section 26, 26' of the footboards are substantially parallel, or horizontal, in relation to a support surface. The second sections 26, 26' are in-plane with each other in order to provide a flat foot platform for the user.

Both horizontal sections 26, 26' have a footpad 28, 28' on their upper surface. Footpads 28, 28' are generally included to increase the traction between the device and a user's foot, although they could also be included for aesthetic reasons such as to display a manufacturer's or sponsor's logo and/or trademark. In a preferred embodiment, footpads 28, 28' consist of a hard texturized plastic firmly affixed to the footboard. Obviously, footpads 28, 28' could be formed from plastics, adhesives, similar materials or any combination thereof. A footpad could also be used if the foot platform consisted of a single, unitary board.

A plurality of fasteners are used to connect the foot platform to the transportation attachment. The number of fasteners is dependent on the exact type and construction of the various transportation attachments. Any type of fastener should securely connect the footboards to the transportation attachment and should provide a high level of stability to device 12 while still providing a user with a quick mechanism to replace or swap various transportation attachments. Also, the weight of user 10 is transmitted by the foot platform to the fasteners so that the fasteners must be of sufficient strength to support a rider.

In the illustrated embodiment, fasteners 30, 30' are bolts. The bolts pass through apertures in vertical sections 24, 24'. It is to be understood that the vertical section of the footboard extends upwards beyond the top of the transportation attachment so that a rider's foot can be placed over the attachment without contacting the attachment.

As briefly noted above, the transportation attachment in FIG. 2 is illustrated as a pair of in-line wheels 18, 20 with integrated axles 22, 22'. The wheels are in a fixed location along the length of the axle but each wheel has a bearing 32 that allows the wheels to rotate about the axle. Fasteners 30, 30' pass through the axles and are held in place by securing members 34, 34'. The width of the axles 22, 22' ensures that they are firmly secured against the footboards.

Figure 3:
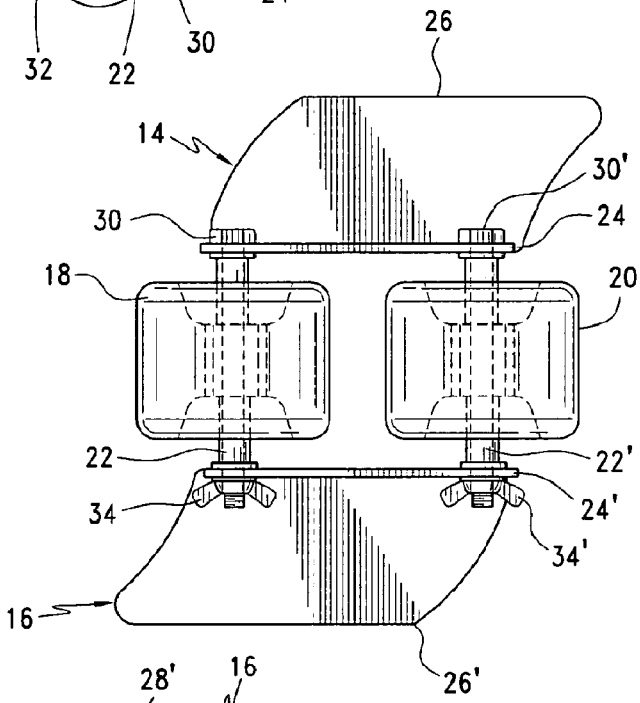
FIG. 3 is bottom plan view of the personal transportation device of the present invention in accordance with the embodiment of FIG. 1.

FIG. 3 is a bottom plan view better detailing axles 22, 22', fasteners 30, 30', and securing members 34, 34'. Fasteners 30, 30' are inserted through apertures in one of the footboards and through axles 22, 22' which act as sleeves for the fasteners. The fasteners are longer than the axles so that they also pass through identical apertures located in the second footboard. The fasteners are then secured in order to prevent them from backing out of the axles by securing members 34, 34', effectively connecting each footboard to the other. Again, it is advantageous to provide a construction that facilitates both the removal and addition of a transportation attachment to device 12. As such, the securing members of the present invention are preferably wingnuts. Wingnuts are particularly advantageous because they do not require a user to have a set of tools to secure or remove the fasteners. However, other securing members such as nuts, clamps, and the like are available.

Figure 4:
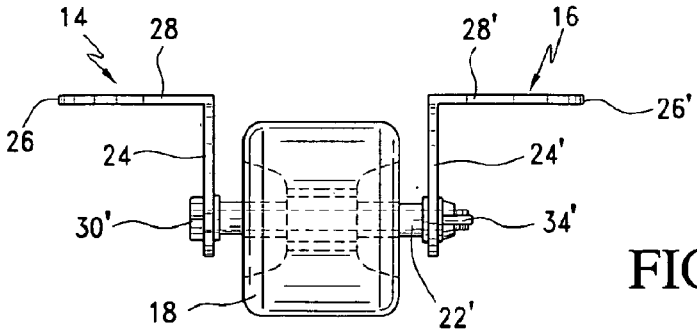
FIG. 4 is an end view of the personal transportation device of the present invention in accordance with the embodiment of FIG. 1.

The spatial relationship of the two footboards can be better seen in FIG. 4. As briefly discussed above, the footboards' vertical sections 24, 24' extend above the transportation attachment. A user's foot is supported by the pair of in-plane horizontal sections 26, 26'. Footpads 28, 28' are located on the upper surface of the horizontal sections.

Although the connection of the transportation attachment to the foot platform has been described in terms of a solid axle assembly, the connection could be achieved by other means. For instance, fasteners, such as bolts, screws or the like, could attach in a double shear fashion wherein the fasteners secure to both sides of the transportation attachment, a cantilevered, single shear connection, not unlike a skateboard truck, is another option.

Figure 5:
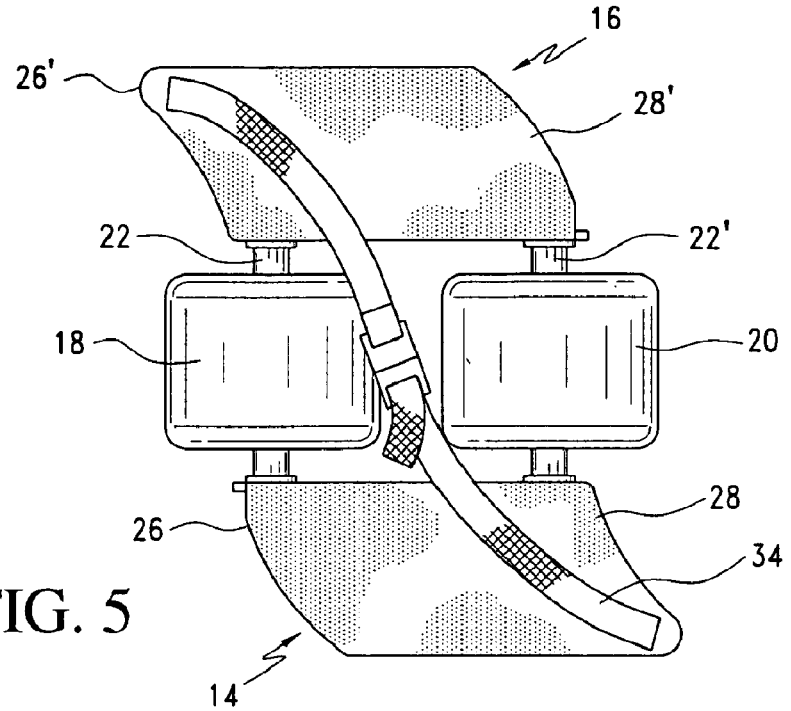
FIG. 5 is a top plan view of the present invention, including a strap to retain a user's foot, in accordance with a second embodiment of the present invention.

FIG. 5 illustrates an embodiment of device 12 wherein an adjustable strap 34 has been included to secure device 12 to a user's foot. Although strap 34 is not necessary, it could be used for acrobatic moves so that device 12 would remain secured to a user's foot during jumps or other tricks. In a preferred embodiment, strap 34 extends diagonally across the width of device 12 so that strap 34 is secured at each of its ends to the furthermost points of footboards 14, 16. Of course, other arrangements are possible. For example, a second strap could be connected at each of its ends to the other two diagonally opposed corners of footboards 14, 16 overlapping the first strap to form an 'X'. A strap, or a plurality of straps, do not necessarily have to bridge the two footboards. Instead, one or more straps could connect only to one footboard forming a loop that a user could insert their foot into. In each case, the straps can be adjustable to allow for variations in foot and shoe sizes.

Figure 6:
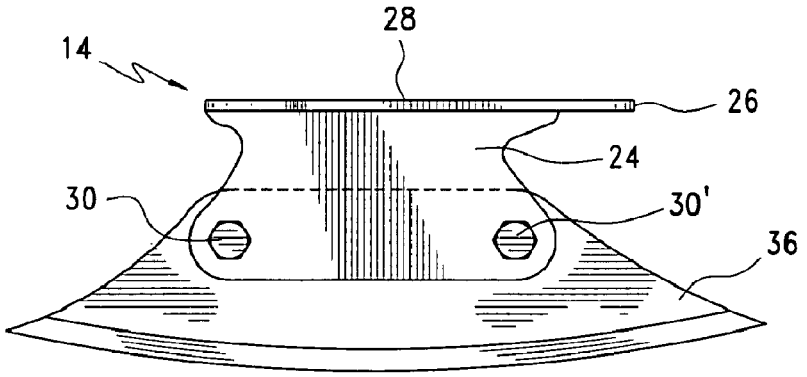
FIG. 6 is a side view of the present invention wherein a ice skating blade attachment is shown in accordance with third embodiment of the present invention.

FIG. 6 illustrates device 12 with one of the various possibilities for a transportation attachment. Here, an ice skating blade serves as the transportation attachment. As above, fasteners 30, 30' pass through the transportation attachment, blade 36, securing the attachment to the footboards. Ideally, an axle, sleeve, or other member provides stability to device 12 by holding blade 36 at a constant distance from both of the footboards.

Figure 7:
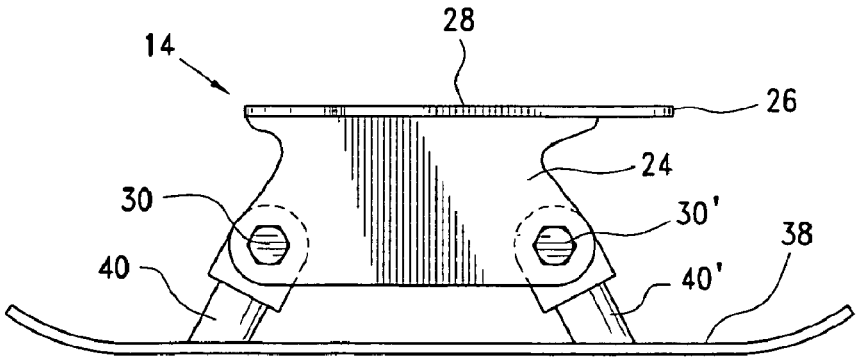
FIG. 7 is a side view of the present invention wherein a ski attachment is shown in accordance with a third embodiment of the present invention.
Figure 10:
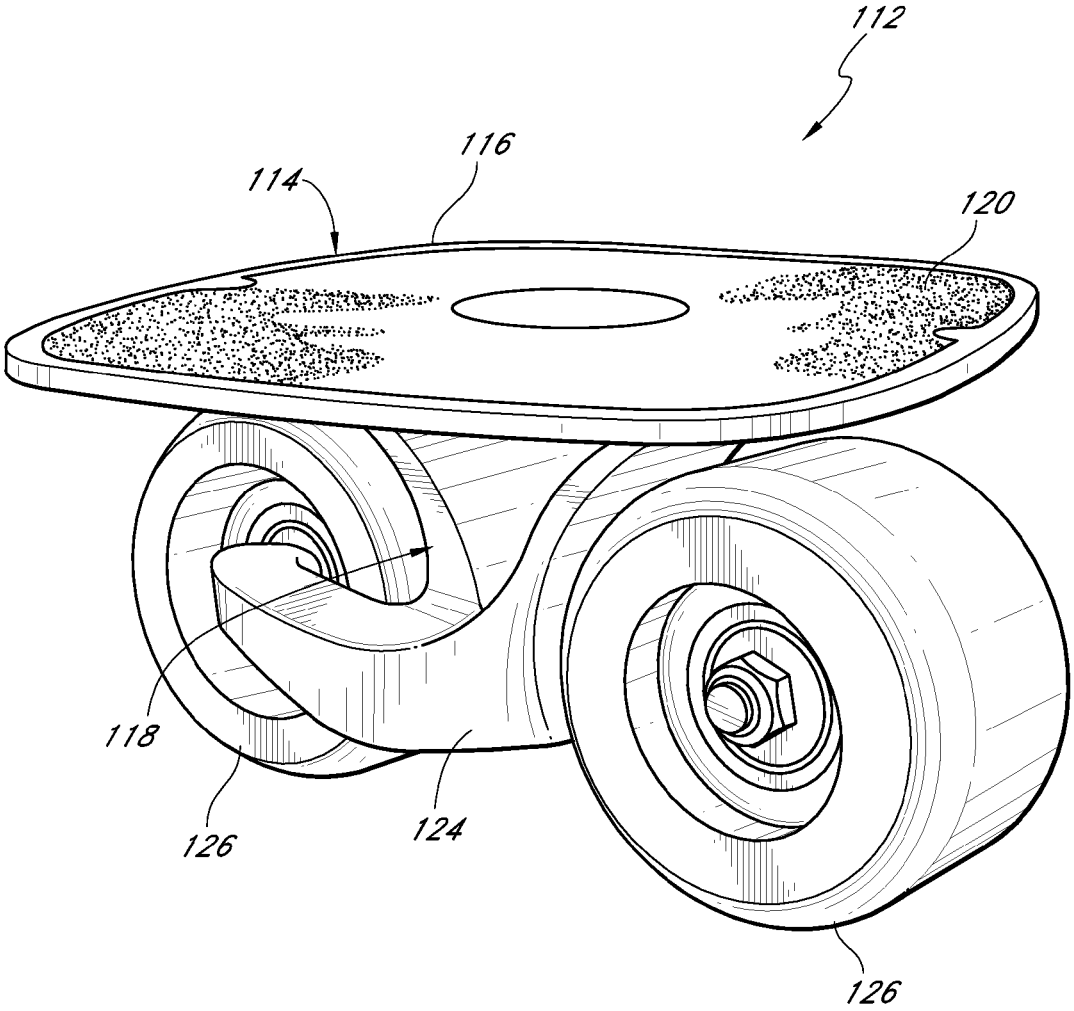
FIG. 10 is a perspective view of an alternate embodiment of the invention.

Along similar lines, FIG. 7 illustrates an embodiment of the present invention wherein a ski 38 acts as the transportation attachment for device 12. In this preferred form, ski 38 includes to two struts 40, 40' that are secured by fasteners 30, 30' to the footboards. The struts extend downward from device 12 to ski 38.

FIGS. 8 and 9 illustrate an embodiment wherein the foot platform consists of a singular footboard 42. As noted above, the foot platform can take a variety of shapes and configurations. In this embodiment, the edges of footboard 42 are formed into sidewalls. The footboard, therefore, is essentially a tray configured to support a user's foot. A plurality of apertures 44, 44' can be included in the sidewalls. A strap, or a plurality of straps, can be connected to the device 12 via the apertures 44, 44'.

Using a single footboard, the transportation attachment can be fastened to the foot platform in a variety of ways. As illustrated, in-line wheels 18, 20 serve as the transportation attachment. An inverted 'U'-shaped bracket 46 is connected to the transportation attachment. A connector 48, such as a bolt, fastens footboard 42 to bracket 46. Connector 48 could supply a pivot. Further, connector 48 can use a known assembly which would allow footboard 42 to rotate relative to the W-line wheels 18, 20.

FIGS. 10-13 illustrate a further embodiment of the invention. The personal transportation device 112 includes a foot platform structure 114 formed by a footboard 116 and an undercarriage 118. The footboard 116 and undercarriage 118 are preferably made as a unitary structure, as, for example, a unitary cast structure.

The footboard 116 defines a longitudinal axis A-A and the undercarriage 118 defines a longitudinal axis B-B. These axes are skewed relative to each other forming the angle $\alpha$ between them.

The footboard has a top surface including a layer 120 which covers a large portion of the surface area of the footboard. The layer 120 comprises a rough surface texture which increases the friction exerted by the footboard against movement of the user's foot when the device is being used.

Figure 11:
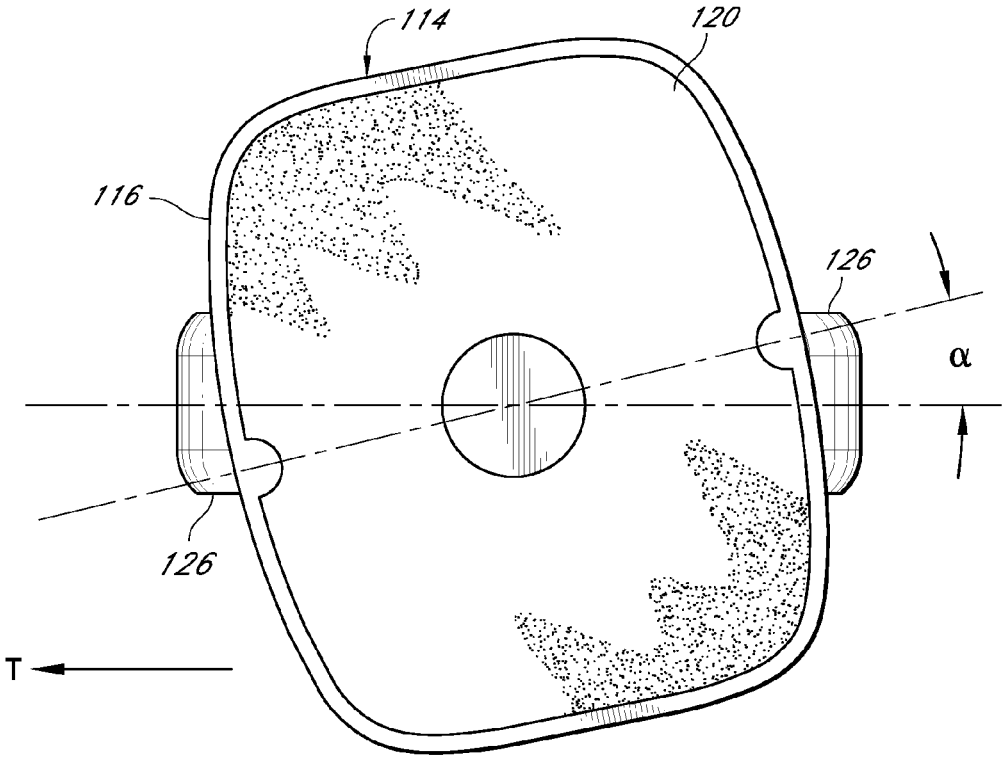
FIG. 11 is a top view of the alternate embodiment of FIG. 10.
Figure 12:
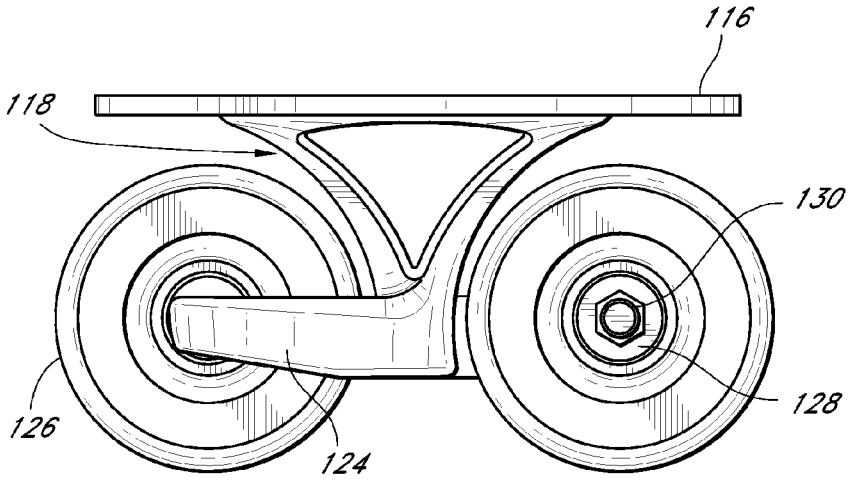
FIG. 12 is a side elevational view of the alternate embodiment of FIG. 10.
Figure 13:
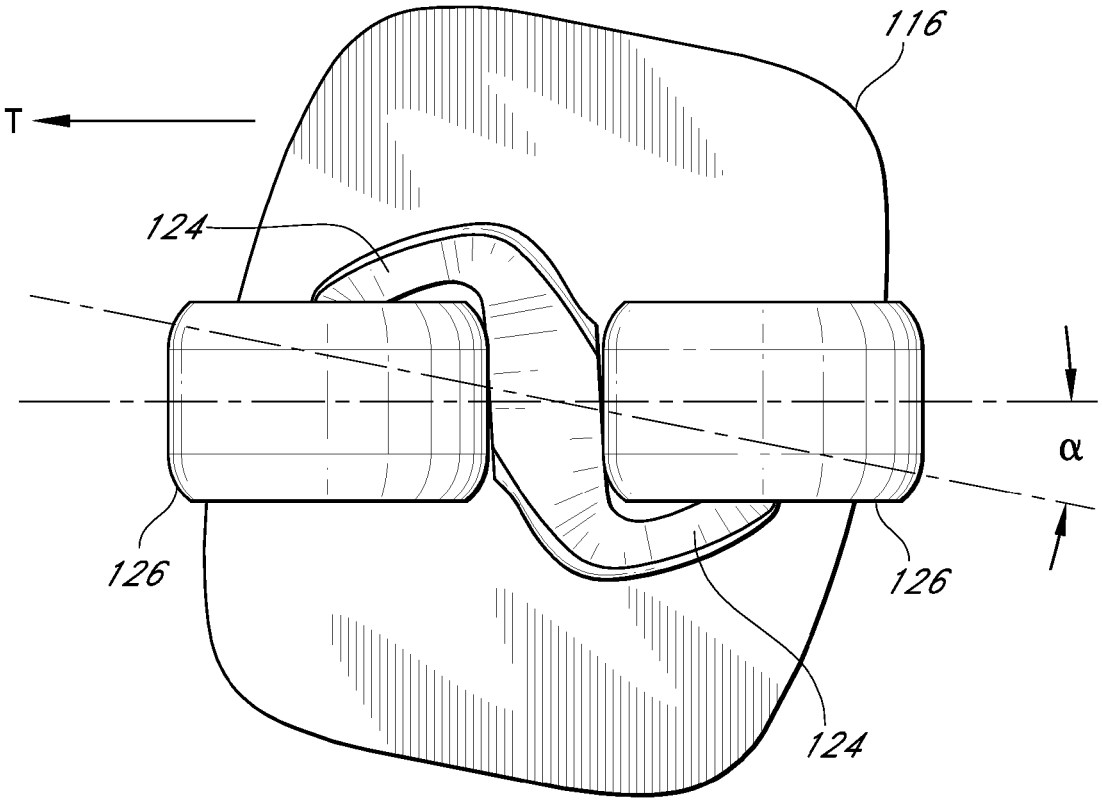
FIG. 13 is a bottom view of the alternate embodiment of FIG. 10.

The undercarriage 118 includes a generally V-shaped connecting frame 122 to which two arms 124 are attached. The arms 124 comprise an S-shaped design, seen most clearly in FIG. 13. The two arms 124 extend generally parallel to each other but in opposite directions to the direction of travel T (FIGS. 11 and 13). Mounted to each arm is a wheel 126 which are connected to its respective arm by a bearing 128 and nut 130. One wheel is shown connected to each arm. However, it should be understood that more than one wheel can be connected in-line to each arm. Preferably, an equal number of wheels are connected to each arm, although that is not necessary, that is, an uneven number of wheels can be connected to the two arms.

In general, the personal transportation device of the present invention allows riders to enjoy a unique method for propelling themselves on two unattached devices. The invention also provides the added advantage of allowing a rider to use various transportation attachments suitable for a variety of surfaces.

Although the present invention has been described in terms of a preferred embodiment, it will be understood that numerous variations and modifications may be made without departing from the invention. Thus, it is to be understood that within the scope of the appended claims, the invention may be practiced otherwise than as specifically described above.

What is claimed is:

1. A personal transportation system, comprising:

first and second transportation assemblies, each of said transportation assemblies being operable in a direction of travel and comprising first and second pluralities of wheels, each of said pluralities of wheels being arranged in an in-line configuration aligned along first and second wheel axes, respectively; and first and second foot platform structures mounted to said first and second transportation assemblies, respectively, each of said first and second foot platform structures including first and second ends, first and second longitudinal axes of each said first and second foot platform structures extending between midpoints of the first and second respective ends of each of said foot platform structures, the first and second longitudinal axes being skewed from the first and second wheel axes, respectively, each of said foot platform structures being sized to support both the toe portion and heel portion of only one of a user's feet, wherein each of said foot platform structures supports a user's foot so that a longitudinal axis of said user's foot can be positioned transversely to said direction of travel of said transportation attachment, and the user employs both of the first and second transportation devices in tandem and provides an oscillating motion for propulsion;

wherein each of said first and second transportation assemblies comprising an undercarriage including two arms which extend generally parallel to each other but in opposite directions relative to the direction of travel.

2. The personal transportation system of claim 1, wherein each of said first and second in-line wheels include an axle and a bearing, said bearings and axles being mounted to a respective arm, and said bearings allowing said first wheel and said second wheel to rotate about their respective axles.

3. The personal transportation device of claim 1, wherein said first and second foot platform structures include a top surface having a rough layer for increasing the friction exerted between said top surface and the user's foot.

4. The personal transportation system of claim 1, wherein the first and second longitudinal axes are skewed from the first and second wheel axes at opposite angles.

5. The personal transportation system of claim 1, wherein the first and second longitudinal axes are skewed from the first and second wheel axes at equal and opposite angles.

6. The personal transportation system of claim 1, wherein the first and second longitudinal axes are skewed from the first and second wheel axes in opposite directions.

7. The personal transportation system of claim 1, wherein each of the first and second pluralities of wheels include no more than first and second wheels.

8. The personal transportation system of claim 7, wherein the first and second foot platform structures comprises left and right lateral edges, the first and second wheels extending beyond the left and right edges, respectively.

* * * * *